US007998917B1

(12) United States Patent
Palmore

(10) Patent No.: US 7,998,917 B1
(45) Date of Patent: Aug. 16, 2011

(54) VISUALLY ENHANCING HEAVY DUTY DEGREASER-CLEANING COMPOSITION

(76) Inventor: Joel F. Palmore, Germantown, MD (US)

( * ) Notice: Subject to any disclaimer, the term of this patent is extended or adjusted under 35 U.S.C. 154(b) by 0 days.

(21) Appl. No.: 12/486,839

(22) Filed: Jun. 18, 2009

(51) Int. Cl.

| | |
|---|---|
| ***C11D 17/06*** | (2006.01) |
| ***C11D 7/06*** | (2006.01) |
| ***C11D 7/16*** | (2006.01) |
| ***C11D 7/28*** | (2006.01) |

(52) U.S. Cl. ..... 510/445; 510/108; 510/109; 510/245; 510/272; 510/365; 510/394

(58) Field of Classification Search ..... 510/245, 510/252, 108, 272, 365, 394, 435, 445, 510, 510/512, 109

See application file for complete search history.

(56) References Cited

U.S. PATENT DOCUMENTS

| | | | | |
|---|---|---|---|---|
| 3,615,827 | A * | 10/1971 | Murphy | 134/38 |
| 3,668,153 | A * | 6/1972 | Crotty | 510/426 |
| 3,679,610 | A * | 7/1972 | Sams et al. | 510/501 |
| 4,093,566 | A | 6/1978 | MacNamara et al. | |
| 4,844,744 | A | 7/1989 | Leiter et al. | |
| 5,127,958 | A * | 7/1992 | Personette | 134/2 |
| 5,433,885 | A * | 7/1995 | Winston et al. | 510/434 |
| 5,597,793 | A * | 1/1997 | Besse et al. | 510/434 |
| 5,705,467 | A * | 1/1998 | Choy | 510/370 |
| 5,770,550 | A * | 6/1998 | Motson | 510/238 |
| 5,972,866 | A * | 10/1999 | Ahmed | 510/218 |
| 6,506,261 | B1 | 1/2003 | Man | |
| 2004/0176263 | A1 * | 9/2004 | Filippini et al. | 510/201 |
| 2005/0272630 | A1 * | 12/2005 | Ajmani et al. | 510/499 |
| 2006/0199755 | A1 * | 9/2006 | Rees et al. | 510/379 |

* cited by examiner

*Primary Examiner* — Lorna M Douyon

(57) ABSTRACT

A visually enhancing degreaser/cleaning composition for removing grease stains adhering to metallic surfaces in the kitchen. The cleaning composition in powder form includes an alkali metal hydroxide, trialkali phosphates, and either polychlorinated copper phthalocyanine or hydrated chromium sesquioxide.

10 Claims, No Drawings

VISUALLY ENHANCING HEAVY DUTY DEGREASER-CLEANING COMPOSITION

BACKGROUND OF THE INVENTION

1. Field of the Invention

The present invention relates to degreaser/cleaning compositions. More particularly, the invention relates to degreaser/cleaning compositions useful for removing cooking oil or shortening and buildups thereof from metallic surfaces.

2. Brief Discussion of the Related Art

The deposits of cooking oils, shortenings, polymerized products and carbonized products occurs on kitchen surfaces such as kitchen stove ventilation hoods, kitchen exhaust stacks, and kitchen exhaust fans in restaurants and commercial institutions. As mandated by the National Fire Code, commercial kitchens are required to regularly clean and remove grease from kitchen exhaust systems to prevent excessive buildup and potential grease fires. In the related art, degreaser/cleaning solutions are difficult to use in removing grease as compared with the degreaser/cleaning composition provided in the present invention.

Deep-fat fryer oil emissions to kitchen exhaust systems generally comprise polymerized and carbonized soils of fats and oils which are typically removed with hazardous, highly alkaline, caustic soda or silicate based corrosive cleaners. This poses potential hazards to users of degreaser/cleaning chemicals due to overspray and overuse of caustic chemicals. Alternatively, degreaser/cleaning applications in the related art call for milder but less effective compositions.

Also, cleaning solutions in the related art will emulsify grease, oil and the like, which will eventually wash out to a sewer-drain. Therefore, the industry requires a biodegradable and environmentally friendly degreaser to cause little or minimal negative ecological impact.

Typically, phosphates are used in degreaser/cleaning compositions. The incorporation of alkali phosphates provide for more effective rinsing of the degreaser/cleaning solution from treated surfaces. Alkali phosphates also sequester metal ions, act as buffers and synergists for the surfactants. Past attempts to control phosphate effluents for environmental reasons have reduced their concentration to fairly low limits. However, in the related art, meeting these constraints by lowering phosphate concentrations has met with some difficulty in that low phosphate cleaners do not perform effectively in meeting their designed objectives. Furthermore, phosphate-free detergent and degreaser compositions in the related art do not give entirely satisfactory results for clean up of cooking oils and fats or their polymerized and carbonized by-products that collect in commercial kitchen exhausts.

Applications of degreaser/cleaning solutions in the related art require multiple applications and a significant amount of time to breakdown grease and deposits. In the related art, it is difficult to determine whether degreaser/cleaning solutions adequately coat grease buildups, which leads to overspray, wastes degreaser/cleaning solutions, and prolongs exposure of users to degreaser/cleaning chemicals. More particularly, soiled surfaces not adequately treated with such degreaser/cleaning solutions are difficult to differentiate from soiled surfaces treated with such degreaser/cleaning solutions.

Therefore, degreaser/cleaning compositions in the related art are either ineffective for use in heavy duty cleaning operations, or too strongly corrosive for metallic surfaces and pose safety problems to users. Furthermore degreaser/cleaning compositions in the related art often contain toxic components, do not biodegrade and are environmentally unfriendly or otherwise unsuitable for large scale industrial and institutional use. Additionally, it is difficult to visually determine whether degreaser/cleaning compositions in the related art adequately coat grease stains in kitchen exhaust systems.

In summary, the use of cooking oils or shortenings worldwide has brought about a need to develop degreaser/cleaning compositions capable of effectively and efficiently cleaning and degreasing multiple kitchen surfaces with visual confirmation of application and removal.

Man, U.S. Pat. No. 6,506,261, discloses nonionic surfactants, silicone surfactants, anionic surfactants, hydrotropes and other optional functional materials including sequestrants. These organic compositions may be effective in removing complex organic soils from wood, metal and other hard surfaces, but do not visually enhance effective cleaning of tenacious polymerized/carbonized soil emitted from deep-fat fryers onto metallic surfaces such as kitchen exhausts.

MacNamara et al. U.S. Pat. No. 4,093,566 discloses a silicate based cleaning composition intended for cleaning metallic ammunition components. These highly alkaline compositions may be useful as a spray cleaner for removing oils and greases, but do not visually enhance effective cleaning of polymerized/carbonized soil from metallic surfaces.

Leiter et al., U.S. Pat. No. 4,844,744 discloses a phosphate-free single phase degreasing composition for cleaning aluminum surfaces. Leiter et al., however, is ineffective in removing polymerized and carbonized soils emitted from cooking and/or frying onto metallic surfaces.

SUMMARY OF THE INVENTION

The present invention provides a novel visually enhancing biodegradable degreaser/cleaning composition in both dry powder and aqueous forms.

According to an aspect of the present invention, a visually enhancing composition in dry powder form useful for degreasing/cleaning when mixed with water includes:

(a) from about 85 to about 95 wt % of an alkali metal hydroxide;

(b) from about 7 to about 11 wt % of a trialkali phosphate; and (c) from about 0.1 to about 1 wt % of hydrated chromium sesquioxide.

According to another aspect of the present invention, a visually enhancing composition in dry powder form useful for degreasing/cleaning when mixed with water includes:

(a) from about 85 to about 95 wt % of an alkali metal hydroxide;

(b) from about 7 to about 11 wt % of a first trialkali phosphate and (c) from about 0.1 to about 1 wt % of polychlorinated copper phthalocyanine.

According to another aspect of the present invention, a visually enhanced water-based degreaser/cleaner solution useful for degreasing/cleaning includes:

(a) from about 4.8 to about 5.4 wt % of an alkali metal hydroxide;

(b) from about 0.4 to about 0.6 wt % of a first trialkali phosphate;

(c) from about 0.01 to about 0.11 wt % of a second trialkali phosphate;

(d) from about 0.01 to about 0.05 wt % of polychlorinated copper phthalocyanine; and (e) the balance water.

DETAILED DESCRIPTION OF EXEMPLARY EMBODIMENTS OF THE INVENTION

The present invention and exemplary embodiments will now be described more fully below.

The visually enhanced degreaser/cleaning powder composition for use in accordance with an exemplary embodiment of the invention includes about 85 to about 95 wt % of an alkali metal hydroxide, and from about 7 to about 11 wt % of a trialkali phosphate.

The alkali metal hydroxide in the solution serves as a degreaser and may be, but not limited to sodium hydroxide or potassium hydroxide. The trialkali phosphate in the composition serves as a degreaser among other uses, and may be, but not limited to, trisodium phosphate.

According to another exemplary embodiment, the degreaser/cleaning powder composition includes about 85 to about 95 wt % of an alkali metal hydroxide, from about 7 to about 11 wt % of a first trialkali phosphate, and from about 0.1 to about 2 wt % of a second trialkali phosphate.

The alkali metal hydroxide in the solution serves as a degreaser and may be, but not limited to sodium hydroxide or potassium hydroxide. The first trialkali phosphate in the composition serves as a degreaser among other uses, and may be, but not limited to, trisodium phosphate. The second trialkali phosphate in the composition serves as an emulsifier/foaming agent and may be, but not limited to trispotassium phosphate.

According to another exemplary embodiment of the present invention, a degreaser/cleaning solution may be created by mixing 8 oz. of the degreaser/cleaning powder compositions as described above with 5 gallons of water. Different amounts of the degreaser/cleaning composition may also be used for stronger or weaker degreaser/cleaning solutions. This concentration of degreaser/cleaning composition to water is effective in removing grease and greasy soil from metallic surfaces such as kitchen exhausts.

According to another exemplary embodiment of the present invention, the visual effectiveness of the degreaser/cleaning composition is further improved by the addition of from about 0.1 to about 1 wt % of either hydrated chromium sesquioxide or polychlorinated copper phthalocyanine.

The concentrated cleaner composition of the present invention can be prepared by blending the above-described components in a usual manner. All components may be mixed at once or the components may be blended in several installments, though it may be widely varied depending on the factors such as the kind and use amount of the components.

Independent laboratory tests have also been undertaken to determine the biodegradability of the liquid degreaser in accordance with the invention. It has been determined that the liquid degreaser is 100% biodegradable within a maximum period of about eight days. These results indicate the excellent biodegradability of the components in the compositions. Although the rate of biodegradation is dependent on environmental factors, given average conditions, residual environmental contaminations is eliminated over a maximum period of 3 and a half months and at least 85% of residual environmental contamination is eliminated within a maximum of 15 days. The composition in accordance with the invention thereby provides an environmentally compatible degreaser which is effective to use as a metallic surface degreaser/cleaner.

The present invention is further described below by referring to the Examples. In the Examples, unless otherwise indicated, the amount of each component used is in the unit of "wt %".

Examples 1 to 6

In each example, a concentrated degreaser/cleaning composition having the formulation shown in each table below was prepared. The components were blended by batch-wise mixing all amounts and stirring the mixture.

A commercially available edible cooking oil for deep fat fryers was charged into an empty container and heated in an oven at 250 degree Celsius over 5 hours to cause thermal denaturation. The test surface consisted of stainless steel and was formed into a double open ended box to resemble a commercial kitchen exhaust. Dimensions of the stainless steel box test surfaces were 42"×24"×36" (L×H×W). The interior of the stainless steel box test surface was then coated by an equal amount of the thermal denatured edible oil for each example. To mimic real world conditions, the stainless steel box test surface was suspended to regulation height for commercial kitchen exhausts prior to application of the degreaser/cleaning solution.

Example 1

| | % by weight |
|---|---|
| alkali metal (sodium) hydroxide | 90.0 |
| trialkali (trisodium) phosphate | 9.5 |
| polychlorinated copper phthalocyanine | 0.5 |
| | 100.0 |

The above degreaser/cleaning composition in Example 1 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed to cover the denatured oil coated test surface. The broken down oil coating the test surface and degreaser/cleaning solution was then rinsed clean by a power pressure washer. The total time for application of the degreaser/cleaning solution and cleaning of the test surface was 10 minutes.

Example 2

| | % by weight |
|---|---|
| alkali metal (sodium) hydroxide | 90.0 |
| trialkali (trisodium) phosphate | 8.5 |
| trialkali (tripotassium) phosphate | 1.0 |
| polychlorinated copper phthalocyanine | 0.5 |
| | 100.0 |

The above degreaser/cleaning composition in Example 2 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed to cover the denatured oil coated test surface. The broken down oil coating the test surface and degreaser/cleaning solution was then rinsed clean by a power pressure washer. The total time for application of the degreaser/cleaning solution and cleaning of the test surface was 9 minutes.

Example 3

| | % by weight |
|---|---|
| alkali metal (sodium) hydroxide | 90.0 |
| trialkali (trisodium) phosphate | 9.5 |
| Hydrated Chromium Sesquioxide | 0.5 |
| | 100.0 |

The above degreaser/cleaning composition in Example 3 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed to cover the denatured oil coated test surface. The broken down oil coating the test surface and degreaser/cleaning solution was then rinsed clean by a power pressure washer. The total time for application of the degreaser/cleaning solution and cleaning of the test surface was 12 minutes.

Example 4

| | % by weight |
|---|---|
| alkali metal (sodium) hydroxide | 90.0 |
| trialkali (trisodium) phosphate | 8.5 |
| trialkali (tripotassium) phosphate | 1.0 |
| hydrated chromium sesquioxide | 0.5 |
| | 100.0 |

The above degreaser/cleaning composition in Example 4 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed to cover the denatured oil coated test surface. The broken down oil coating the test surface and degreaser/cleaning solution was then rinsed clean by a power pressure washer. The total time for application of the degreaser/cleaning solution and cleaning of the test surface was 11 minutes.

Example 5

| | % by weight |
|---|---|
| alkali metal (sodium) hydroxide | 90.0 |
| trialkali (trisodium) phosphate | 10.0 |
| | 100.0 |

The above degreaser/cleaning composition in Example 5 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed onto the denatured oil coated test surface. The broken down oil coating the test surface and degreaser/cleaning solution was then rinsed clean by a power pressure washer. The total time for application of the degreaser/cleaning solution and cleaning of the test surface was 18 minutes.

Example 6

| | % by weight |
|---|---|
| alkali metal (sodium) hydroxide | 90.0 |
| trialkali (trisodium) phosphate | 9.0 |
| trialkali (tripotassium) phosphate | 1.0 |
| | 100.0 |

The above degreaser/cleaning composition in Example 6 was mixed with water in an amount of 8 ounces of the degreaser/cleaning composition to 5 gallons of water at a temperature of about 88 degrees Celsius. The solution was then slowly mixed and poured into a chemical sprayer for application. The degreaser/cleaning solution was then evenly sprayed onto the denatured oil coated test surface. The broken down oil coating the test surface and degreaser/cleaning solution was then rinsed clean by a power pressure washer. The total time for application of the degreaser/cleaning solution and cleaning of the test surface was 16 minutes.

In comparing examples 1-4 to examples 5-6, it is shown that the inclusion of either hydrated chromium sesquioxide or polychlorinated copper phthalocyanine in the cleaner/degreaser solution visually enhanced the coverage of the degreaser/cleaning solution onto the soiled surfaces, required less cleaning/degreaser solution, and therefore decreased degreasing/cleaning time. Furthermore, visually determination of degreasing/cleaning action of the degreaser/cleaning solutions was easier with inclusion of either hydrated chromium sesquioxide or polychlorinated copper phthalocyanine. Thus, application of the degreaser/cleaning solution with either hydrated chromium sesquioxide or polychlorinated copper phthalocyanine was easier, faster, and more readily visible.

As described above and shown in Examples 1-6, the inclusion of either hydrated Chromium sesquioxide or polychlorinated copper phthalocyanine is advantageous for, but not limited to, a) visually enhancing the degreaser/cleaning solution with green coloring, b) increased differentiation between soiled surfaces treated with the visually enhanced degreaser/cleaning solution and untreated soiled surfaces, and c) decreased cleaning and degreasing time.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A visually enhancing composition in dry powder form useful for degreasing/cleaning kitchen exhaust surfaces when mixed with water consisting of:

(a) from about 85 to about 95 wt % of an alkali metal hydroxide;

(b) from about 7 to about 11 wt % of a first trialkali phosphate;

(c) optionally, from about 0.1 to about 2 wt % of a second trialkali phosphate; and (d) from about 0.1 to about 1 wt % of hydrated chromium sesquioxide to produce a green coloring to enhance visualization of the application and removal of the composition.

2. The composition of claim 1 wherein the second trialkali phosphate is present in the composition.

3. The composition of claim 1 wherein the alkali metal hydroxide is sodium hydroxide.

4. The composition of claim 1 wherein the first trialkali phosphate is trisodium phosphate.

5. The composition of claim 2 wherein the second trialkali phosphate is tripotassium phosphate.

6. A composition in dry powder form useful for degreasing/cleaning kitchen exhaust surfaces when mixed with water consisting of:

(a) from about 85 to about 95 wt % of an alkali metal hydroxide;

(b) from about 7 to about 11 wt % of a first trialkali phosphate;

(c) optionally, from about 0.1 to about 2 wt % of a second trialkali phosphate; and (d) from about 0.1 to about 1 wt % of polychlorinated copper phthalocyanine to produce a green coloring to enhance visualization of the application and removal of the composition.

7. The composition of claim 6 wherein the second trialkali phosphate is present in the composition.

8. The composition of claim 6 wherein the alkali metal hydroxide is sodium hydroxide.

9. The composition of claim 6 wherein the first trialkali phosphate is trisodium phosphate.

10. The composition of claim 7 wherein the second trialkali phosphate is tripotassium phosphate.

* * * * *